US009534469B2

(12) United States Patent
Hunt

(10) Patent No.: US 9,534,469 B2
(45) Date of Patent: Jan. 3, 2017

(54) STACKED TRAY BALL DROPPER FOR SUBTERRANEAN FRACKING OPERATIONS

(71) Applicant: Baker Hughes Incorporated, Houston, TX (US)

(72) Inventor: Jay J. Hunt, Pueblo West, CO (US)

(73) Assignee: Baker Hughes Incorporated, Houston, TX (US)

( * ) Notice: Subject to any disclaimer, the term of this patent is extended or adjusted under 35 U.S.C. 154(b) by 566 days.

(21) Appl. No.: 14/040,198

(22) Filed: Sep. 27, 2013

(65) Prior Publication Data

US 2015/0090438 A1 Apr. 2, 2015

(51) Int. Cl.
*E21B 33/068* (2006.01)

(52) U.S. Cl.
CPC ..... *E21B 33/068* (2013.01)

(58) Field of Classification Search
None
See application file for complete search history.

(56) References Cited

U.S. PATENT DOCUMENTS

| | | | | |
|---|---|---|---|---|
| 4,427,065 | A | 1/1984 | Watson | |
| 4,759,469 | A * | 7/1988 | Lowrance | B65G 29/02 198/467.1 |
| 5,040,603 | A | 8/1991 | Baldridge | |
| 5,590,713 | A | 1/1997 | Baugh et al. | |
| 5,758,726 | A | 6/1998 | Streich et al. | |
| 5,934,377 | A | 8/1999 | Savage | |
| 5,960,881 | A | 10/1999 | Allamon et al. | |
| 6,206,095 | B1 | 3/2001 | Baugh | |
| 6,220,360 | B1 | 4/2001 | Connell et al. | |
| 6,715,541 | B2 | 4/2004 | Pedersen et al. | |
| 6,776,228 | B2 | 8/2004 | Pedersen et al. | |
| 6,959,764 | B2 | 11/2005 | Preston | |
| 6,959,766 | B2 | 11/2005 | Connell | |
| 7,100,700 | B2 | 9/2006 | Davis et al. | |
| 7,231,589 | B2 | 6/2007 | Yamagata et al. | |
| 7,571,773 | B1 | 8/2009 | West et al. | |
| 7,607,481 | B2 | 10/2009 | Barbee | |
| 7,624,810 | B2 | 12/2009 | Fould et al. | |
| 7,661,478 | B2 | 2/2010 | Palmer et al. | |
| 8,256,514 | B2 | 9/2012 | Winzer | |
| 2003/0141052 | A1 * | 7/2003 | Pedersen | E21B 33/05 166/70 |

(Continued)

OTHER PUBLICATIONS

Team Oil Tools, "Ball Lauch Head", 2012, 1 page.

*Primary Examiner* — Jennifer H Gay
*Assistant Examiner* — Caroline Butcher
(74) *Attorney, Agent, or Firm* — Steve Rosenblatt

(57) ABSTRACT

A ball dropper has a stack of trays that have solid portions for supporting a ball and open portions to allow a ball to pass through a tray. Fixed barriers limit the travel of the ball with the rotating tray to allow the ball to become unsupported so that it can be caught on the tray below. A stepper motor precisely makes the required incremental rotation to allow the addition of the next ball at the top. Once the trays are filled or the balls loaded are advanced such that the lead ball is on the last tray any further rotation will start to discharge the balls with each increment of rotation. The device is easy and cheap to fabricate and presents a reliable way to get jam free operation while having a housing that will tolerate the operating pressures in the wellbore.

21 Claims, 2 Drawing Sheets

(56) References Cited

U.S. PATENT DOCUMENTS

| | | | | |
|---|---|---|---|---|
| 2010/0294511 | A1* | 11/2010 | Winzer ..... | E21B 33/068 166/382 |
| 2011/0174505 | A1 | 7/2011 | Gill et al. | |
| 2012/0152525 | A1 | 6/2012 | McGuire et al. | |
| 2012/0181032 | A1 | 7/2012 | Naedler et al. | |
| 2012/0279717 | A1 | 11/2012 | Young et al. | |
| 2013/0028326 | A1 | 1/2013 | Moriya et al. | |
| 2013/0153237 | A1 | 6/2013 | McGuire | |

* cited by examiner

STACKED TRAY BALL DROPPER FOR SUBTERRANEAN FRACKING OPERATIONS

FIELD OF THE INVENTION

The field of the invention is ball dropping devices and more particularly devices that hold multiple balls of different sizes that are sequentially dropped using a rotating tray mechanism for loading and release of the balls.

BACKGROUND OF THE INVENTION

Sequential fracking procedures frequently involve the dropping of balls of progressively larger sizes for isolation of segments of a zone to be treated using a series of progressively larger ball seats. Typically devices that drop multiple balls associate a release plunger with each ball and vertically stack all the balls. These devices are top loaded and after inserting each ball the plunger above is extended to catch the next ball to be loaded. These devices tend to be heavy to set up, cumbersome to deal with a myriad of hydraulic control lines and expensive to fabricate and ship to the desired location. Typical of such designs are U.S. Pat. No. 8,256,514 and U.S. Publication 2013/0228326. In a variation of this theme the balls are stored in side chambers with a discrete actuator for each ball and the associated lines for hydraulically moving each ball into the central bore for dropping or pumping to the desired landing location. Some examples of such a design are U.S. Pat. Nos. 7,571,773 and 7,624,810. Some designs use applied pressure or pressure cycles to release discrete balls as shown in U.S. Pat. Nos. 7,100,700; 6,959,766 and 6,220,360. Yet other designs use a single plunger that releases a single ball with each stoke cycle where the balls are all the same size or the balls are of progressively larger sizes and the plunger opens a different amount in each cycle to release progressively bigger balls. Such designs are shown in U.S. Publication 2012/0152525 and 2012/0279717. In other designs the balls are stored in a recess outside the passage in the mandrel and rotation of the housing holding a ball aligns an outlet in the housing with a mandrel wall opening to release a ball as shown in U.S. Pat. No. 5,758,726. In another design involving relative rotation, the balls are in adjacent axial barrel chambers and barrel rotation successively aligns a barrel with a ball in it to an outlet path. This design places the balls in the same horizontal plane and has a very limited ball capacity as a result. This design is shown in U.S. Pat. No. 6,206,095. Other designs use a 90 degree mechanical rotation either by hand or with a power assist to rotate a support out from under a ball so that the ball can drop. These designs are shown in U.S. Pat. Nos. 6,715,541; 4,427,065; 5,590,713; 7,281,589; 6,776,228 and U.S. Publication 2013/0153237. The following references more generally relate to ball dropping devices but do not fall into any of the above described variations: U.S. Pat. No. 7,661,478 and U.S. Publication 2011/0174505.

What is needed and provided by the present invention is a ball dropping device that can hold enough different or same sized balls and is simple to build, load and operate. This is accomplished by a set of spaced parallel trays that have solid and open portions that are rotatable in tandem and operate in conjunction with stops that are stationary so that tray rotation causes balls to be stopped by the stationary stops as tray rotation brings an open portion of a tray under the ball and lets it fall through. This allows loading by periodic insertion of balls when the unit is empty that advance in tandem toward a lower end outlet with an adjacent flow line to allow pumping each dropped ball to its ultimate destination. A single driver such as a stepper motor makes the needed movements in the desired increments for all the trays. An indication of how many balls and their size that have been dropped can also be incorporated into the design. Those skilled in the art will better appreciate these and other aspects of the present invention from a review of the description of the preferred embodiment and the associated drawings while recognizing that the full scope of the invention is to be determined from the appended claims.

SUMMARY OF THE INVENTION

A ball dropper has a stack of trays that have solid portions for supporting a ball and open portions to allow a ball to pass through a tray. Fixed barriers limit the travel of the ball with the rotating tray to allow the ball to become unsupported so that it can be caught on the tray below. A stepper motor precisely makes the required incremental rotation to allow the addition of the next ball at the top. Once the trays are filled or the balls loaded are advanced such that the lead ball is on the last tray any further rotation will start to discharge the balls with each increment of rotation. The device is easy and cheap to fabricate and presents a reliable way to get jam free operation while having a housing that will tolerate the operating pressures in the wellbore.

DETAILED DESCRIPTION OF THE PREFERRED EMBODIMENT

Figure 1:
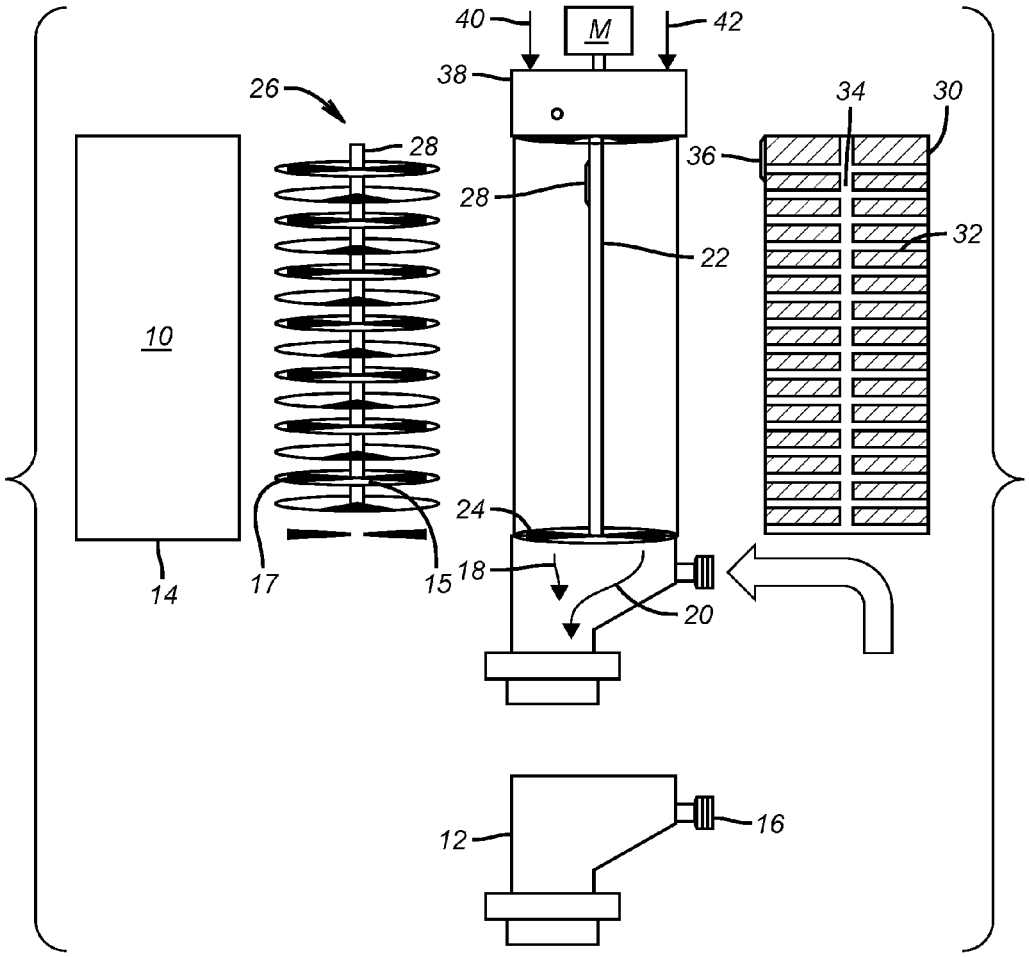
FIG. 1 is an exploded view of the components of the ball dropper with balls advancing with 90 degree rotation increments.

A housing 10 is shown rolled flat in FIG. 1. A bottom sub 12 is connected at lower end 14 of the housing 10. The bottom sub 12 has a fluid inlet 16 so that a released ball represented by arrows 18 or 20 can be pumped to its landing location that is not shown. A motor M drives a drive shaft 22 to which is attached the lowermost tray 24 for tandem rotation. The stack of trays 26 has a hollow and internally splined shaft 28 that can slip over drive shaft 22 that has a schematically illustrated mating spline 28 so that the trays 26 rotate in tandem with shaft 28 and bottom tray 24.

Figure 3:
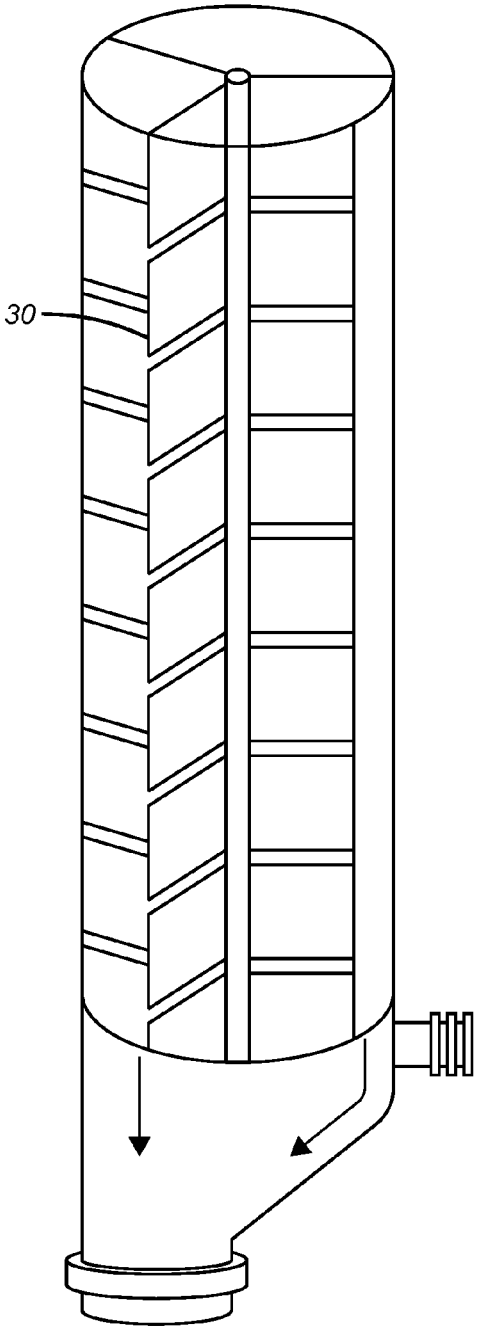
FIG. 3 shows the fixed assembly of rotation stops for the balls but with the trays removed.
Figure 4:
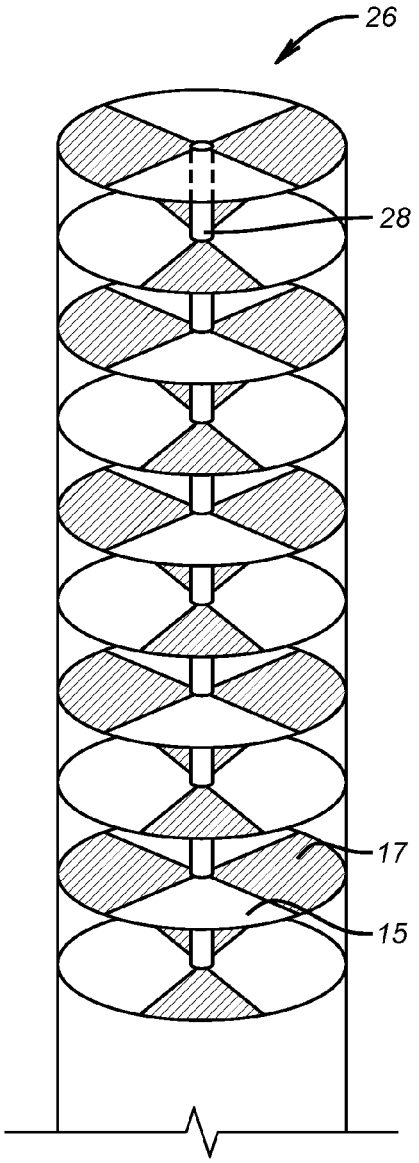
FIG. 4 shows the stack of trays before it is slipped on the drive shaft.

A cylindrically shaped frame 30 has radially extending members 32 that are spaced so that they will be disposed just above a corresponding tray 24 or 26 when the long slot 34 is aligned with shaft 22 and the frame 30 and tray stack 26 a placed in concentric or nearly concentric overlapping relation. FIG. 3 shows the frame 30 alone mounted to the drive shaft 22 with the trays 24 and 26 removed. FIG. 4 shows the stack of trays 26 with its structural shaft 28 that would be slipped into splined engagement with shaft 22 with the frame 30 already in position so that the extending members 32 are positioned slightly above each tray 24 and 26. The frame 30 can also be secured such as with a schematically illustrated spline 36 to the housing 10 to prevent relative rotation between them.

Figure 2:
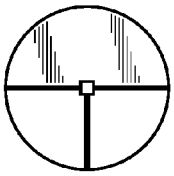
FIG. 2 is an alternative tray design that advances the balls on 180 rotation increments.

As shown in FIG. 1 the trays can have alternating 90 degree solid portions or segments 17 with open 90 degree portions or segments 15 in between. Alternatively, as shown in FIG. 2 the trays can be half solid and half open. A top sub 38 can have two load locations represented by arrows 40 and 42 for loading another ball after each rotation of the motor M. Ideally one ball should be loaded on each tray but with the FIG. 1 design that spaces the solid portions on each tray it is possible to load 2 balls separated from each other with an open segment on each tray 24. Using the configuration in FIG. 2 a single ball per tray is preferred.

The tray spacing can be the same or variable to accommodate progressively larger balls. The housings 10 can be stacked or mounted side by side to accommodate even more balls. When stacking the bottom subs can be configured without the offset shown in FIG. 1 so that a single motor can drive connected shafts in stacked units. The units can be easily transported as their height is minimized by the close tray spacing that is otherwise not achievable with hydraulic plungers and their actuators that have to be associated with each ball in prior designs. There is no issue of hanging up the balls because there are no plungers whose movement in some designs varies to let progressively larger balls. Instead the balls advance in unison with each turn increment dropping another ball. Optional features can be added such as a counter that either literally counts balls as they drop or discrete turns of the stepper motor M to display how many balls have been released.

The above description is illustrative of the preferred embodiment and many modifications may be made by those skilled in the art without departing from the invention whose scope is to be determined from the literal and equivalent scope of the claims below.

I claim:

1. An apparatus for delivering multiple objects to a subterranean location, comprising:

a housing having an inlet for loading the objects and an outlet for discharge of the objects;

discrete supports for each of the objects in said housing, said supports moving at the same time for controlled sequential dropping of the objects onto another support located below and from said housing when no further supports are located below.

2. The apparatus of claim 1, wherein:

said supports rotate.

3. The apparatus of claim 2, wherein:

said supports are equally or unequally spaced.

4. The apparatus of claim 3, wherein:

movement of said supports allows all objects to axially advance from one support to another underlying support, or through said outlet in the case of an object on a lowermost of said supports.

5. The apparatus of claim 4, wherein:

rotation of said supports brings a travel stop into contact with a respective object on each support to stop rotational movement of the object until sufficient rotation of said supports aligns an opening with the object to let the object pass through the support that had previously supported the object.

6. The apparatus of claim 5, wherein:

said supports are associated with a common shaft that is rotationally locked to a drive shaft driven by a motor.

7. The apparatus of claim 6, wherein:

said travel stop associated with a respective support comprises a single assembly of said stops that nests with a common shaft that spaces said supports.

8. The apparatus of claim 7, wherein:

said assembly of said stops is rotationally locked to said housing.

9. The apparatus of claim 8, wherein:

each said support comprises a disc with at least one closed and at least one open portion.

10. The apparatus of claim 1, wherein:

said supports are equally or unequally spaced.

11. The apparatus of claim 1, wherein:

movement of said supports allows all objects to axially advance from one support to another underlying support, or through said outlet in the case of an object on a lowermost of said supports.

12. The apparatus of claim 1, wherein:

rotation of said supports brings a travel stop into contact with a respective object on each support to stop rotational movement of the object until sufficient rotation of said supports aligns an opening with the object to let the object pass through the support that had previously supported the object.

13. The apparatus of claim 12, wherein:

said travel stop associated with a respective support further comprises a plurality of spaced stops disposed in a single assembly on a common shaft that alternates said stops with said supports.

14. The apparatus of claim 13, wherein:

said assembly of said stops is rotationally locked to said housing.

15. The apparatus of claim 13, wherein:

said assembly of said stops comprises an axial slot to straddle said common shaft.

16. The apparatus of claim 12, wherein:

each said supports comprises multiple and alternating open and closed portions.

17. The apparatus of claim 1, wherein:

said supports are associated with a common shaft that is rotationally locked to a drive shaft driven by a motor.

18. The apparatus of claim 17, wherein:

said motor comprises a stepper motor.

19. The apparatus of claim 1, wherein:

said housing further comprises a fluid connection adjacent a lower end thereof for pumping a released object that drops from said lowermost support.

20. The apparatus of claim 1, wherein:

each said support comprises a disc with at least one closed and at least one open portion.

21. The apparatus of claim 20, wherein:

each said supports comprises multiple and alternating open and closed portions.

* * * * *